US007833086B2

(12) United States Patent
Mielke

(10) Patent No.: US 7,833,086 B2
(45) Date of Patent: Nov. 16, 2010

(54) METHOD AND APPARATUS FOR GRINDING THE BLADE TIPS OF A ROTOR WHEEL IN BLISK DESIGN

(75) Inventor: Rainer Mielke, Oberursel (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 12/149,839

(22) Filed: May 8, 2008

(65) Prior Publication Data

US 2008/0280546 A1 Nov. 13, 2008

(30) Foreign Application Priority Data

May 8, 2007 (DE) ..... 10 2007 022 467

(51) Int. Cl.
*B24B 49/00* (2006.01)

(52) U.S. Cl. ..... 451/11; 451/47

(58) Field of Classification Search ..... 451/11, 451/47, 127, 130, 150, 160
See application file for complete search history.

(56) References Cited

U.S. PATENT DOCUMENTS

| | | | | |
|---|---|---|---|---|
| 4,471,673 | A * | 9/1984 | Rosenquist | 76/41 |
| 5,197,191 | A * | 3/1993 | Dunkman et al. | 29/889.1 |
| 5,800,103 | A * | 9/1998 | Stadtfeld et al. | 409/27 |
| 7,125,312 | B2 | 10/2006 | Castañares | |
| 7,303,461 | B1 * | 12/2007 | Campomanes et al. | 451/28 |
| 7,320,635 | B2 * | 1/2008 | Cendak | 451/419 |
| 7,473,160 | B1 * | 1/2009 | Gerstner | 451/7 |
| 2003/0024825 | A1 * | 2/2003 | Lamphere et al. | 205/640 |
| 2004/0124181 | A1 * | 7/2004 | Wei et al. | 219/68 |
| 2004/0198197 | A1 * | 10/2004 | Schwartz et al. | 451/61 |
| 2008/0131216 | A1 * | 6/2008 | Sasu et al. | 407/113 |
| 2009/0075564 | A1 * | 3/2009 | Schwartz et al. | 451/11 |

FOREIGN PATENT DOCUMENTS

| | | | |
|---|---|---|---|
| DE | 603 02 660 | T2 | 8/2006 |
| DE | 10 2005 041 031 | A1 | 3/2007 |
| EP | 0592112 | A1 * | 4/1994 |
| EP | 1 129 813 | A1 | 9/2001 |
| EP | 1 433 557 | A2 | 6/2004 |
| EP | 1 491 289 | A | 12/2004 |

* cited by examiner

*Primary Examiner*—Maurina Rachuba
(74) *Attorney, Agent, or Firm*—Timothy J. Klima; Shuttleworth & Ingersoll, PLC

(57) ABSTRACT

Tip grinding of BLISK blades is performed in a static state of an incrementally rotatable BLISK, with a rotational axis (9) of a grinding wheel (4), which is traversable along an upper edge of the blade, being aligned diagonally to an orientation of the blade upper edge, and hence, in a direction of maximum resistance moment of the blades. The apparatus for the performance of the method features a locating device (7) for a BLISK which is incrementally rotatable by an auxiliary drive (8) as well as a high-speed shaft (3) driven by a main drive (2) for blade tip grinding of conventional rotor wheels fittable to the high-speed shaft (3). The grinding wheel (4) is traversable in Y-direction and rotatable about a center axis extending in X-direction, such that the blade tips in the static state can be ground in the direction of the maximum resistance moment of the blades.

1 Claim, 1 Drawing Sheet

Figure 1:
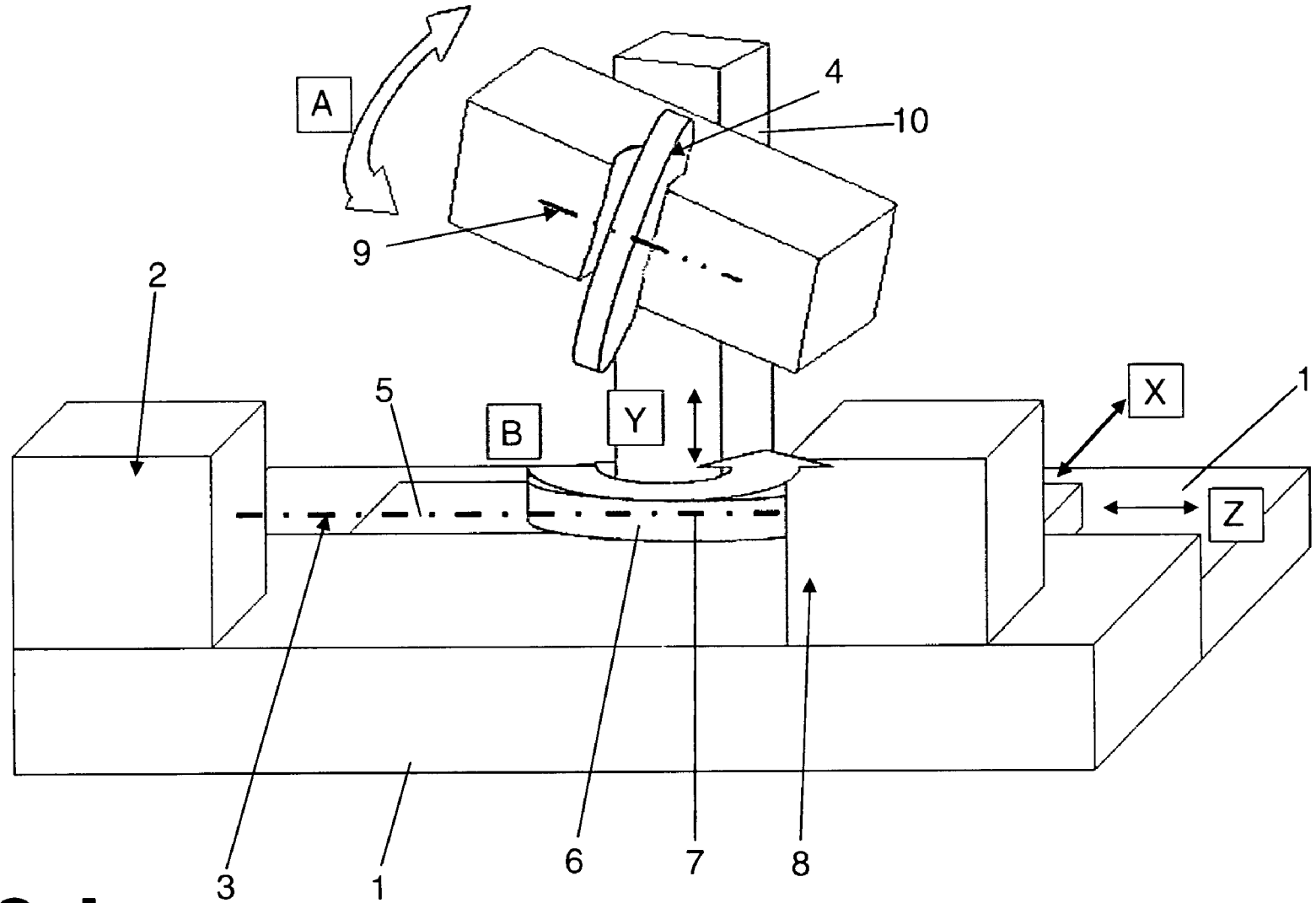

METHOD AND APPARATUS FOR GRINDING THE BLADE TIPS OF A ROTOR WHEEL IN BLISK DESIGN

This application claims priority to German Patent Application DE102007022467.4 filed May 8, 2007, the entirety of which is incorporated by reference herein.

This invention relates to an apparatus for grinding the blade tips of a rotor wheel in BLISK design and having at least one blade row, and more particularly for compressors of gas-turbine engines, with the apparatus having a rotatable locating device for mounting the rotor wheel and a grinding wheel rotating about a rotational axis and arranged on a carriage adjustable along the locating device in Z-direction and normal to the locating device in X-direction. The present invention also relates to a method for grinding the blade tips of BLISKS.

Grinding apparatuses of the type specified at the beginning are generally known and are successfully used for grinding the blade tips of the blades of conventional rotor wheels which are separately manufactured and attached to the rotor disk. As the rotor or the rotor drum (rotor wheel or rotor wheel drum) together with the locating device rotate at high speed, the blades are forced radially outwards by the centrifugal force, thereby settling firmly, but damped, on the grinding wheel during the grinding operation.

Compared with conventional rotor wheels and grinding methods, significantly higher vibrations occur during grinding the blade tips of integrally designed rotors or rotor drums of the compressors of aircraft gas turbines, these being due to the low damping effect between the disk and the integrally formed-on blades. As a result of this, the blades are highly loaded and may unwind under the effect of the grinding wheel force. Blade life and dimensional accuracy are thus affected. Therefore, tip grinding of rotor wheels in BLISK design with the known grinding apparatuses is only possible at significantly lower grinding speeds, with grinding performance being accordingly reduced.

In order to avoid the disadvantages caused by vibration of the BLISK blades during grinding with conventional tip grinding arrangements and methods, it is known to provide elastic damping mechanisms between the blades. Apart from the fact that the damping mechanisms may get detached in operation due to the high centrifugal forces, their installation and removal incurs considerable effort.

A broad aspect of the present invention is to provide an apparatus for grinding the blade tips of rotor wheels or rotor wheel drums of compressors for gas-turbine engines which enables rotors in BLISK design that feature a long service-life to be manufactured in high quality and with reduced work effort.

The basic idea of the present invention is that the blade tips of a BLISK are, in the static state, individually ground in the direction of the maximum resistance momentum of the blades, i.e. the grinding direction and the force effect of the grinding wheel, respectively, are essentially in agreement with the orientation or the direction of the blade upper edge. The individual blades, whose tendency to vibrate is significantly reduced by the grinding direction selected, are thus subject to substantially lower loads during grinding. Machining accuracy can be increased and grinding time as well as energy consumption reduced. The reduced load during grinding provides for an increase in service-life of the blades or the BLISK, respectively. Moreover, sparking will not compromise the quality of the adjacent blades during the grinding process. Grinding is preferably performed from the leading edge and the trailing edge to the center of the upper edge of the respective blade, thereby further reducing the hazard of damage involved with tip grinding blades made of brittle materials or featuring sensitive geometries.

The apparatus for the performance of the method according to the present invention comprises an incrementally rotatable locating device for the BLISK or BLISK drum, respectively, and a grinding wheel which is longitudinally traversable and vertically positionable to the BLISK drum as well as adjustable for height and swivellable about a horizontal axis to enable it to be set—during the grinding operation—in agreement with the orientation of the blade upper edge, i.e. in the direction of the maximum momentum of resistance of the blade. In addition, the grinding wheel is also swivellable about a vertical axis to enable its position to be adjusted to the cone of the adjacent blade rows of a BLISK drum.

For grinding conventional rotor wheels, the apparatus may be provided with a high-speed shaft enabling a conventional rotor wheel, mounted to the high-speed shaft and rotating at high speed, to be ground at the blade tips in the known manner by means of a grinding wheel, which in this case is stationary and not swivelled.

An embodiment of the present invention will be more fully described by way of the accompanying drawing.

FIG. 1 schematically shows an apparatus for grinding the blade tips of rotors in BLISK design as well as of conventionally designed rotors.

Arranged on the machine bed 1 of the apparatus is, as shown on the drawing, a main drive 2 with a high-speed shaft 3 to which a conventionally designed rotor wheel comprising a rotor disk with separately manufactured blades detachably held in the rotor disk or a correspondingly designed rotor wheel drum (either not shown) can be mounted for blade tip grinding. As the blade row to be machined at the blade tips is here rotated at high speed and the blades are radially forced outwards by the centrifugal force, the blades locate, in a damped manner, on a grinding wheel 4 rotating in the same plane (not shown) as the high-speed shaft 3, enabling the blade tips to be ground with high grinding speed and in good quality. The grinding wheel 4 is arranged on a carriage 5 which is traversable on the machine bed 1 longitudinally to the high-speed shaft 3 (Z-direction, as indicated by double arrow Z) and vertically to the high-speed shaft 3 in X-direction, as indicated by double arrow X, to enable the grinding wheel 4 to be approached to the blade tips in accordance with the blade height (X-direction) and—in the case of a rotor drum—traversed to the adjacent blade row (Z-direction).

For grinding the blade tips of a BLISK-type rotor wheel or a rotor wheel drum, respectively, the blades are mounted on a rotatable locating device 7 which, independently of the main drive 2 of the high-speed shaft 3, is incrementally driven by an auxiliary drive 8 provided on the machine bed 1. For simplicity, the locating device 7 is only shown in the form of a center axis, as is the high-speed shaft 3.

The grinding wheel 4, which is rotatable about a rotational axis 9, is mounted to a column 10 rotatable on the carriage 5 about a vertical axis in the direction of arrow B. The carriage 5 and the column 10 are rotatably connected by a rotary table 6 with integrated drive (not shown). The grinding wheel 4 is connected to the column 10 in such a manner that it is vertically adjustable, i.e. for height, along the column 10, as indicated by double arrow Y, and also swivellable (rotatable) about a horizontal axis (X direction) normal to the vertical axis of the column 10, as indicated by double arrow A. In other words, the rotational axis 9 of the grinding wheel 4 is also rotatable in the direction of arrow A, so that the grinding wheel 4 does not lie in the same plane as the respective blade row of the BLISK or the BLISK drum, but is settable to the respective orientation of the blade tips of the blade row to be machined.

The procedure for grinding the blade tips of rotor wheels or a rotor wheel drum, respectively, by use of the apparatus described above in light of FIG. 1 is detailed as follows:

The blade tips of conventional rotor wheels, which comprise a rotor disk on the periphery of which separately manufactured blades are held in a slot, are ground in the generally known way in that the rotor wheel to be machined is mounted on the high-speed shaft 3 and the grinding wheel 4 is positioned, as indicated by double arrow Z, to the level of the blade row to be machined and to the blade tips in accordance with the blade height. The grinding wheel 4 is in a vertical position in which its rotational axis 9 is parallel to the high-speed shaft 3 or the rotor wheel axis, respectively. As the rotor wheel rotates at high speed, the blades are forced outwards by the centrifugal force, and their tips ground in a shock-absorbent position.

For grinding the blade tips of a BLISK drum, the BLISK drum is mounted on the locating device 7 connected to the auxiliary drive 8. The carriage 5 is traversed in X-direction and in Z-direction to position the grinding wheel 4 to the tip of a blade of the blade row to be machined. The rotational axis 9 of the grinding wheel 4 is set, i.e. swivelled, and traversed in Y-direction such during the grinding process that its grinding direction is always parallel to the stagger angle of the blade tip or the orientation of the blade upper edge, respectively, and—thus—the grinding wheel 4 is essentially positioned in agreement with the orientation of the blade tip and follows the orientation of the blade tip as it is traversed in Y-direction. The blade tip is thus ground —in an energy-saving way—in the static state in the direction of its highest momentum of resistance, as a result of which the tendency to vibrate during grinding is substantially reduced, thereby improving the dimensional accuracy of the grinding process and increasing the life of the blades. Since the grinding wheel 4 is positioned along the blade upper edge, sparking no longer reaches the adjacent blades during blade tip grinding, preventing the blade surface finish to be affected. Tip grinding is preferably performed from the leading edge and the trailing edge to the center of the respective blade, thereby minimising the hazard of failure of the blade tip involved with tip grinding blades made of brittle materials and/or featuring sensitive geometries. Contouring the grinding wheel in accordance with the annulus contour is not required.

Upon grinding a blade tip, the BLISK drum is rotated by the auxiliary drive 8 into a position which enables the next blade of the blade row to be ground. When all blade tips of a blade row of the BLISK drum are ground, the grinding wheel 4 is positioned to the adjacent blade row by traversing the carriage 5, with the blade being set such by rotating the column 10 with the rotary table 6 that it is positioned in conformance with the cone of the adjacent blade row or the cone of the BLISK drum, respectively. Subsequently, grinding of the blade tips of this blade row is accomplished in the manner described in the above.

Apart from the advantages already described, grinding times are reduced and the effort for clamping the blades can be dispensed with.

LIST OF REFERENCE NUMERALS

1 Machine bed
2 Main drive for 3
3 High-speed shaft
4 Grinding wheel
5 Carriage
6 Rotary table
7 Locating device for BLISKS (BLISK rotational axis)
8 Auxiliary drive for 7
9 Rotational axis of 4
10 Column of 4
Double arrow X Positioning of 4 in X-direction
Double arrow Z Positioning of 4 in Z-direction
Arrow B Direction of rotation of 10 about vertical axis
Double arrow A Direction of swiveling (rotating) of 9/4

What is claimed is:

1. A method for alternatively grinding blade tips of rotor wheels in BLISK configuration and rotor wheel drums, comprising:

providing a grinding wheel with a flat grinding surface rotatable about a rotational axis thereof, the grinding wheel traversable in a Z-direction longitudinally to the rotor wheel/rotor wheel drum and vertically to the to the rotor wheel/rotor wheel drum in a Y-direction;

positioning the rotor wheel/rotor wheel drum so that an axis thereof is parallell with an axis of the Z-direction and making the rotor wheel/rotor wheel drum incrementally rotatable about that axis;

adjusting the grinding wheel for height along the blade tips in the Y-direction and rotating it about an axis extending in an X-direction to adjust the grinding wheel in a direction of orientation of a blade upper edge, also rotating the grinding wheel about an axis extending in the Y-direction to adjust the grinding wheel to a cone of adjacent blade rows;

individually grinding each blade tip in a static state in a direction of maximum resistance momentum of the blade along an upper edge of the blade and with the rotational axis of the grinding wheel being oriented diagonally to the blade upper edge; wherein the blade tips are ground each from a leading edge and from a trailing edge to a center of the upper edge of the blade.

* * * * *